US006391253B1

(12) United States Patent
Tochihara et al.

(10) Patent No.: US 6,391,253 B1
(45) Date of Patent: May 21, 2002

(54) STAINLESS STEEL HAVING EXCELLENT ANTIBACTERIAL PROPERTY AND METHOD FOR PRODUCING THE SAME

(75) Inventors: Misako Tochihara; Takeshi Yokoto; Susumu Satoh; Sadao Hasuno, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/403,328

(22) PCT Filed: Mar. 15, 1999

(86) PCT No.: PCT/JP99/01239

§ 371 Date: Nov. 5, 1999

§ 102(e) Date: Nov. 5, 1999

(87) PCT Pub. No.: WO99/47721

PCT Pub. Date: Sep. 23, 1999

(30) Foreign Application Priority Data

Mar. 16, 1998 (JP) ..... 10-065924

(51) Int. Cl.[7] ..... C22C 38/18; C21D 8/02

(52) U.S. Cl. ..... 420/35; 148/605; 148/609; 420/40; 164/459

(58) Field of Search ..... 420/34, 35, 40; 164/459; 148/325, 605, 609, 611

(56) References Cited

U.S. PATENT DOCUMENTS 3,723,102 A * 3/1973 Lowe ..... 75/128 R
4,649,983 A * 3/1987 Laxmanan et al. ..... 164/154
RE32,925 E * 5/1989 Chen et al. ..... 148/403
4,883,544 A * 11/1989 Ueda et al. ..... 148/542
5,820,817 A * 10/1998 Angeliu et al. ..... 420/40
5,861,068 A * 1/1999 Hasegawa et al. ..... 148/326
5,983,980 A * 11/1999 Freeman et al. ..... 164/480

FOREIGN PATENT DOCUMENTS

| | | | |
|---|---|---|---|
| JP | 8-104952 | | 4/1996 |
| JP | 08104952 A | * | 4/1996 |
| JP | 8-104953 | | 4/1996 |
| JP | 08104953 A | * | 4/1996 |
| JP | 8-156175 | | 6/1996 |
| JP | 8-239726 | | 9/1996 |

OTHER PUBLICATIONS

Harcourt Academic Press Dictionary of Science and Technology, http://www.harcourt.com/dictionary/, Accessed Apr. 11, 2001. Definitions of "casting" and "forging".*

* cited by examiner

*Primary Examiner*—Roy King
*Assistant Examiner*—Harry D. Wilkins, III
(74) *Attorney, Agent, or Firm*—Schnader Harrison Segal & Lewis LLP

(57) ABSTRACT

The present invention provides a stainless steel being excellent in workability, corrosion resistance and antibacterial property. To be more specific, a stainless steel containing 10 wt % or more of Cr is rendered to contain 0.0001–1 wt % of Ag, or further one or more members selected from Sn: 0.0002–0.02 wt %, Zn: 0.0002–0.02 wt %, Pt: 0.0002–0.01 wt %, and, in addition, is rendered to dispersedly contain a total of 0.001 % or more in an area percentage of one or more members of a silver particle, a silver oxide and a silver sulphide each having a mean grain diameter of 500 $\mu$m or less. To disperse the silver particle, silver oxide and silver sulphide uniformly, the casting rate of continuous casting is preferably controlled to range from 0.8 to 1.6 m/min.

14 Claims, No Drawings

STAINLESS STEEL HAVING EXCELLENT ANTIBACTERIAL PROPERTY AND METHOD FOR PRODUCING THE SAME

TECHNICAL FIELD

The present invention relates to a stainless steel, in particular to a stainless steel having excellent antibacterial property and being suitable for the applications of, for example, kitchen utensils and other daily utensils, medical devices, electrical equipment, chemical instruments and construction materials. The steels in the present invention include steel sheets, steel strips, steel pipes and steel wires.

BACKGROUND ART

Silver and copper have been known to have effects of suppressing growth of pathogenic bacteria typically including *Escherichia coli* and salmonellae and hence preventing food poisoning linked to such pathogenic bacteria.

Recently, materials obtained by using these metals and having inhibitory effect on bacterial growth (hereinafter referred to as "antibacterial property") have been proposed.

By way of illustration, Japanese Unexamined Patent Publication No. 8-49085 discloses a stainless steel sheet having excellent antibacterial property obtained by forming a metal layer or alloy later of Cr, Ti, Ni, Fe or the like containing Ag and/or Cu on the surface of a stainless steel matrix through magnet sputtering. This steel sheet is preferably obtained by forming a metal layer or alloy layer containing 19 to 60 wt % of Ag.

Separately, Japanese Unexamined Patent Publication No. 8-156175 proposes a coated steel sheet obtained by applying a pigment containing silver to suppress bacterial growth.

However, the aforementioned process of forming a metal layer or alloy layer containing an antibacterial metal onto the surface of a steel sheet and the process of applying a pigment containing an antibacterial metal have the following problems: The surface layer containing the antibacterial metal is peeled or removed through drawing or grinding of the surface, and the effects of the surface layer are no longer provided. In addition, the antibacterial property cannot be retained for a long duration in the applications where the surface of the steel is always rubbing such as in a steel sheet used for interior trim of washing machines or in the applications where the surface of steel is always rubbed by cleansing as in kitchen utensils. According to the above processes, extra manufacturing steps for coating or for forming a metal or alloy layer are required than conventional processes, and with a decreasing thickness of sheet the surface area per unit weight increases and hence the coating amount or the amount of the metal layer or alloy layer per unit weight increases, which results in unfavorably increasing costs.

Japanese Unexamined Patent Publication No. 8-239726 discloses an antibacterial and anti-maricolous-organism material comprising, by weight, Fe: 10 to 80%, Al: 1 to 10%, or in addition, 1 to 15% of at least one member of Cr, Ni, Mn, Ag with the balance being copper and incidental impurities. This material is, however, a copper-based alloy or iron-based alloy containing 1 to 10% Al, has low workability and is still problematic for the application as thin steel sheets as in eating utensils, kitchen utensils and parts of electrical equipment.

To solve the aforementioned problems, Japanese Unexamined Patent Publication No. 8-104953 proposes an austenitic stainless steel having improved antibacterial property obtained by adding 1.1 to 3.5 wt % Cu, and Japanese Unexamined Patent Publication No. 8-104952 proposes a martensitic stainless steel having improved antibacterial property obtained by adding 0.3 to 5 wt % Cu.

According to the technologies described in Japanese Unexamined Patent Publication No. 8-104953 and Japanese Unexamined Patent Publication No. 8-104952, however, Cu as ions must be eluted from the surface of the steel sheet to develop antibacterial property. The elution of Cu as ions means the destruction of a passivation film at the same site, and hence the corrosion resistance is extremely deteriorated although the antibacterial property is improved. According to such a Cu-added stainless steel, therefore, the antibacterial property can hardly be compatible with the corrosion resistance.

It is an object of the present invention to provide both a stainless steel and a method of producing the same, which stainless steel can advantageously solve the problems of conventional technologies and has excellent workability and corrosion resistance, and in addition has still excellent antibacterial property even when subjected to currently-employed surface finishing inclusive of grinding.

DISCLOSURE OF INVENTION

The present inventors made intensive investigations on the relation between the chemical composition of the surface of a stainless steel sheet and the antibacterial property, using analyzers such as a field emission type Auger electron spectroscope and an electron beam microanalyzer in order to develop a stainless steel sheet compatibly having antibacterial property, and excellent workability and corrosion resistance. Consequently, they newly found that stainless steel sheets having high antibacterial property and, add to this, excellent workability and corrosion resistance can be obtained by adding a proper amount of Ag to a stainless steel and making one or more members of silver particles, silver oxides and silver sulphides to occur on the surface of resultant stainless steel sheets. They further found that these stainless steel sheets have stable antibacterial property even in the applications to be subjected to forming or grinding or in the applications where the surfaces are rubbed or abraded.

The present invention has been accomplished based upon the above findings and further investigations.

(1) A stainless steel having excellent antibacterial property and containing 10 wt % or more Cr and 0.0001 to 1 wt % Ag, wherein the steel includes a total of 0.001 or more in area percentage of one or more members selected from a silver particle, a silver oxide and a silver sulphide.

(2) The stainless steel having excellent antibacterial property according to (1), wherein the stainless steel contains one or more members selected from: Sn: 0.0002 to 0.02 wt %, Zn: 0.0002 to 0.02 wt %, Pt: 0.0002 to 0.01 wt %.

(3) The stainless steel having excellent antibacterial property according to (1) or (2), wherein the silver particle, silver oxide and silver sulphide each have a mean grain diameter of 500 $\mu$m or less.

(4) A method of producing a stainless steel material having excellent antibacterial property, which method comprises continuously casting a molten stainless steel containing Cr: 10 wt % or more, Ag: 0.0001 to 1 wt % to give a steel material, wherein the casting rate of the continuous casting ranges from 0.8 to 1.6 m/min.

(5) The method of producing a stainless steel material having excellent antibacterial property according to (4), wherein the molten stainless steel contains one or more members selected from Sn: 0.0002 to 0.02 wt %, Zn: 0.0002 to 0.02 wt %, Pt: 0.0002 to 0.01 wt %.

(6) A method of producing a cold-rolled stainless sheet steel, wherein the stainless steel obtained according to (4) or (5) is further subjected to hot-rolling, cold-rolling.

BEST MODE FOR CARRYING OUT THE INVENTION

The content limits of the chemical composition of the steel according to the present invention will now be described.

The steel of the invention can advantageously be applied to any of austenitic stainless steels, ferritic stainless steels, martensitic stainless steels and a variety of other stainless steels.

The austenitic stainless steel preferably has a chemical composition of: C: 0.01 to 0.1 wt %, Si: 2.0 wt % or less, Mn: 2.0 wt % or less, P: 0.08 wt % or less, S: 0.02 wt % or less, Cr: 10 to 35 wt %, Ni: 6 to 15 wt %, N:0.01 to 0.1 wt % with the balance being Fe and incidental impurities. The steel may further comprise one or more members selected from: Mo: 3.0 wt % or less, Cu: 1.0 wt % or less, W: 0.30 wt % or less, V: 0.30 wt % or less, Al: 0.3 wt % or less, Ti: 1.0 wt % or less, Nb: 1.0 wt % or less, Zr: 1.0 wt % or less, B: 0.01 wt % or less.

The ferritic stainless steel preferably has a chemical composition of: C: 0.01 wt % or less, Si: 1.0 wt % or less,Mn: 2.0 wt % or less, P: 0.08 wt % or less, S: 0.02 wt % or less, Cr: 10 to 35 wt %, N: 0.10 wt % or less with the balance being Fe and incidental impurities. The steel may further comprise one or more members selected from: Al: 0.3 wt % or less, Ni: 1.0 wt % or less, Mo: 3.0 wt % or less, Ti: 1.0 wt % or less, Nb: 1.0 wt % or less, V: 0.30 wt % or less, Zr: 1.0 wt % or less, Cu: 1.0 wt % or less, W: 0.30 wt % or less, B: 0.01 wt % or less.

The martensitic stainless steel preferably has a chemical composition of: C: 0.01 to 0.07 wt %, Si: 1.0 wt % or less, Mn: 2.0 wt % or less, P: 0.08 wt % or less, S: 0.02 wt % or less, Cr: 12 to 17 wt %, N: 0.007 to 0.03 wt % with the balance being Fe and incidental impurities. The steel may further comprise one or more members selected from: Al: 1.5 wt % or less, Ti: 0.6 wt % or less, Nb: 0.5 wt % or less, V: 0.30 wt % or less, W: 0.30 wt % or less, Zr: 1.0 wt % or less, Ni: 3.0 wt % or less, Mo: 3.0 wt % or less, Cu: 1.0 wt % or less, B: 0.01 wt % or less.

According to the present invention, Ag: 0.0001 to 1 wt %, or, in addition, one or more members selected from Sn: 0.0002 to 0.02 wt %, Zn: 0.0002 to 0.02 wt %, Pt: 0.0002 to 0.01 wt % are added to a stainless steel, preferably to a stainless steel having the chemical composition of the aforementioned range.

Cr: 10 wt % or more.

Cr is an essential alloy component to ensure corrosion resistance of the stainless steels and is required to be contained in a content of 10 wt % or more.

Ag: 0.0001 to 1 wt %.

Ag is the most important element in the present invention and is an element acting to suppress bacterial growth and to enhance antibacterial property. Ag provides these benefits when at least 0.0001 wt % is present. On the other hand, if Ag content exceeds 1 wt %, the corrosion resistance is deteriorated though the antibacterial property is enhanced, and surface defects are increased in a hot-rolling process. In addition, a large amount of expensive Ag must be added, thereby increasing costs. Consequently, Ag content is controlled to the range of 0.0001 to 1 wt %. Ag content is more preferably less than 0.05 wt %.

According to the present invention, Ag to be contained in the steel should be contained as one or more members selected from an Ag (silver) particle, a silver oxide and a silver sulphide in total in an area percentage of 0.001% or more. Ag as an Ag (silver) particle, silver oxide or silver sulphide which is dispersedly present on the surface of a steel material in use suppresses bacterial growth and markedly enhances antibacterial property. The Ag (silver) particle, silver oxide and silver sulphide may be present independently or as a complex compound composed of two or three members.

The persistent presence of the silver particle, silveroxide or silver sulphide dispersedly on the surface of the steel in use is essential to ensure stable antibacterial property. The silver particles, silver oxides or silver sulphides are preferably present on the surface, not only on the surface upon shipment of steel products but also on the surface after polishing, cutting/grinding or the surface of steel in use where a new surface is formed by abrasion or the like.

The presence of Ag in the steel is evaluated by the area percentage in the surface of a cross section to be determined, which area percentage is measured by subjecting an arbitrary cross section of a test piece sampled from the steel to element mapping determination with an X-ray microanalyzer.

When the total content of one or more members selected from a silver particle, a silver oxide and a silver sulphide is less than 0.001% in area percentage, no suppressing effect on bacterial growth is observed and no antibacterial property is exhibited. On the other hand, if the total content in area percentage exceeds 30%, the benefits of enhancing antibacterial property no more accrues and Ag content increases, thereby increasing costs, and, in addition, deteriorating corrosion resistance. Consequently,the total content of one or more members selected from a silver particle, a silver oxide and a silver sulphide is controlled to the range from 0.001% to 30% in area percentage. The mean grain diameters of the silver particle, silver oxide and silver sulphide exceeding 500 $\mu$m can cause deterioration of corrosion resistance and workability. Therefore, the components preferably have a mean grain diameter of 500 $\mu$m or less.

According to the present invention, it is desirable that the steel further comprises one or more members selected from: Sn: 0.0002 to 0.02 wt %, Zn: 0.0002 to 0.02 wt %, Pt: 0.0002 to 0.01 wt %, in addition to Ag in the above range.

Each of Sn, Zn, Pt acts to disperse and precipitate the silver particle, silver oxide, silver sulphide and to thereby stabilize the development of antibacterial property. At least 0.0002 wt % for Sn, at least 0.0002 wt % for Zn and at least 0.0002 wt % for Pt must be present to obtain these benefits. On the other hand, if the contents exceed 0.02 wt % for Sn, 0.02 wt % for Zn and 0.01 wt % for Pt, the benefits do no more accrue, and workability and corrosion resistance are liable to be deteriorated. The contents are, therefore, preferably controlled to the ranges of 0.0002 to 0.02 wt % for Sn, 0.0002 to 0.02 wt % for Zn and 0.0002 to 0.01 wt % for Pt.

The stainless steel of the present invention is composed of, in addition to the above chemical composition, the balance being Fe and incidental impurities. From the viewpoint of preventing the deterioration of corrosion resistance, the content of soluble oxides and sulphides other than silver oxides and silver sulphides is preferably reduced as much as possible.

The steel of the present invention can be formed into an ingot by applying any of conventional known steel making techniques and hence the steel making technique used in the invention is not limited. Regarding steel making techniques, the molten steel can be prepared by, for example, refining in a converter or an electric furnace and then to secondary refining by SS-VOD (Strongly Stirred Vacuum Oxygen Decarburization).

The molten steel obtained by steel making technique can be formed into a steel material by any of conventional known casting methods, whereas continuous casting is preferably employed for productivity and quality.

In the continuous casting, the casting rate preferably ranges from 0.8 to 1.6 m/min in order to disperse the silver particle, silver oxide, silver sulphide in the steel finely and uniformly.

When the casting rate is less than 0.8 m/min, the silver particle, silver oxide or silver sulphide becomes coarse, thereby deteriorating corrosion resistance and inhibiting stable development of antibacterial property. On the other hand, when the casting rate exceeds 1.6 m/min, Ag is not uniformly dispersed in the steel, and hence the silver particle, silver oxide or silver sulphide is not dispersedly present on the surface of the steel in use, thereby inhibiting stable development of antibacterial property. For these and other reasons, the casting rate in the continuous casting preferably ranges from 0.8 to 1.6 m/min.

According to the present invention, a molten stainless steel having the above chemical composition is subjected to,preferably continuous casting under the above conditions, to give a steel material, and subsequently the steel material is heated to a given temperature according to necessity and hot-rolled under generally known hot-rolling conditions to give a hot-rolled steel sheet having a desired thickness. The hot-rolled steel sheet is annealed at 700 to 1180° C. according to the steel composition and then cold-rolled under general known cold-rolling conditions to give a cold-rolled steel sheet having a given thickness.

The cold-rolled steel sheet is preferably subjected to annealing at 700 to 1180° C. according to the steel composition and pickling to give a cold-rolled and annealed steel sheet.

EXAMPLES

A series of stainless steels having chemical compositions shown in Table 1 through Table 3 were prepared by steel making process, and subjected to continuous casting with varying casting rates to give slabs each having a thickness of 200 mm, and the slabs were heated and hot-rolled to give hot-rolled steel sheets each having a thickness of 4 mm. The he hot-rolled steel sheets were annealed at 700 to 1180° C., pickled and then cold-rolled to give cold-rolled sheet steels each having a thickness of 1.0 mm. The cold-rolled steel sheets were then annealed and pickled to give cold-rolled and annealed steel sheets. The annealing temperatures of the cold-rolled steel sheets were 1100° C. for austenitic ($\gamma$) stainless steels, 850° C. for ferritic($\alpha$) stainless steels and 800° C. for martensitic ($\alpha'$) stainless steels.

A workability test, corrosion resistance test and antibacterial property test were performed on the cold-rolled and annealed steel sheets. Incidentally, to verify the durability of the antibacterial property, the same antibacterial property test was carried out after the corrosion resistance test.

The test methods of the above individual tests will be described below.

(1) Antibacterial Property Test

The antibacterial property was evaluated in accordance with a film adhesion method of Study Group on Silver and Other Inorganic Antibacterial Agents. The procedure of the film adhesion method of Silver and Other Inorganic Antibacterial Agents is as follows:

(1) Wash and degrease a test piece of 25 $cm^2$ with, for example, absorbent cotton containing 99.5% ethanol.

(2) Disperse *Escherichia coli* into a 1/500 NB solution. (The cell count of *Escherichia coli* was adjusted to $2.0\times10^5$ to $1.0\times10^6$ cfu (colony form unit)/ml. The 1/500 NB solution was a medium obtained by diluting a nutrient broth medium (NB) with sterile purified water by a factor of 500. The nutrient broth medium (NB) is a medium composed of meat extract 5.0 g, sodium chloride 5.0 g, peptone 10.0 g, and purified water 1,000 ml with pH: 7.0+0.2)

(3) Inoculate 0.5 ml/25 $cm^2$ of the bacterial dispersion to test pieces (each three pieces).

(4) Cover the surfaces of the test pieces respectively with a film.

(5) Hold the test pieces under conditions of a temperature (35±1.0° C.), RH (relative humidity) of 90% or more for 24 hr.

(6) Determine the viable cell counts through agar culture (35±1.0° C., 40 to 48 hr).

The antibacterial property was evaluated according to the count decreasing rate after the test in four tiers, ◎, ○, Δ, ×. The symbol ◎ corresponds to the case that all three test pieces had count decreasing rates of 99.3% or more, the symbol ○ corresponds to the case that all the three test pieces had count decreasing rates of 99.0% or more and less than 99.3%, the symbol Δ corresponds to the case that one of the three test pieces had a count decreasing rate of 99.0% or more, and the symbol × corresponds to the case that all the three test pieces had count decreasing rates of less than 99.0%.

The count decreasing rate is defined by the following formula.

Count decreasing rate (%)=(cell count of control-cell count after the test)/(cell count of control)×100

The cell count of control was defined as the viable cell count after the antibacterial property test in a sterile Petri dish, and was $9.30\times10^7$ cfu/ml. The cell count after the test was the measured viable cell count.

Using the test pieces after the corrosion resistance test, the antibacterial property test was conducted to evaluate the durability of antibacterial property in a similar manner.

(2) Corrosion Resistance Test

The corrosion resistance was evaluated through a salt-dry-wet complex cycle test.

A test piece was subject to a cycle of the following treatments (1) and (2)

(1) Spray a 5.0% NaCl aqueous solution (temperature: 35° C.) to the test piece for 0.5 hr and hold it under a dry atmosphere at a humidity of 40% or less and a temperature of 60° C. for 1.0 hr.

(2) Retain the test piece under a wet atmosphere at a humidity of 95% or more and a temperature of 40° C. for 1.0 hr and the cycle was repeated a total of 10 cycles, and the rusting area percentage (%) of the surface of the test piece was determined. The rusting area percentage less than 5% was indicated as ○, the rusting area percentage of 10% or more was indicated as ×, and the rusting area percentage of5% or more and less than 10% was indicated as Δ.

(3) Workability Test

The workability was evaluated through an adherence bending test. The adherence bending test was conducted in accordance with Japanese Industrial Standards (JIS) Z 2248, the method for bending tests of metal materials, at an inner diameter of 0 mm and bending angle of 180° . The test piece having no cracks at the bending site was indicated as ○ and that having cracks was evaluated as ×.

(4) Mutagenicity Test

As a mutagenicity test, a reverse mutation test including activation of metabolism was carried out using *Escherichia coli* WP2 uvr A strain, and *Salmonella typhimurium* TA line as test microorganisms. The sample in which the count of reverse mutation colonies increased was assessed as positive (+), and that in which the count did not change was assessed as negative (−).

The results of the above tests are shown in Table 4 through Table 6.

Table 4 through Table 6 demonstrate that steel sheets containing Ag, and one or more members of a silver particle, a silver oxide and a silver sulphide on their surface in a total amount within the ranges specified in the present invention (inventive examples) were excellent in workability and corrosion resistance, and in addition superior in antibacterial property as decreasing the cell count of *Escherichia coli* 99% or more in the antibacterial property test; and that these steels decreased *Escherichia coli* even in the test pieces after the corrosion resistance test and hence had excellent durability of the antibacterial property. The mentioned results, not depending on the species of stainless steels, were observed in any of austenitic, ferritic and martensitic stainless steels. Further, all the steel sheets according to the present invention (inventive examples) were negative in the mutagenicity test using microorganisms, inviting no safety problems.

On the contrary, the comparative examples whose compositions were out of the scope of the present invention showed, regardless of the species of stainless steels, less decrease rates of *E. coli*, indicating deteriorated antibacterial property, or showed decreased antibacterial property after the corrosion resistance test, indicating deteriorated durability of the antibacterial property.

INDUSTRIAL APPLICABILITY

The present invention can provide stainless steels having excellent antibacterial property without deteriorating workability and corrosion resistance, and still having satisfactory antibacterial property even after subjected to surface finishing including grinding, with superior advantages in industrial fields. In addition, the present invention also exhibits an advantage to widen the range of applications of stainless steels even to applications in which workability is strongly desired and antibacterial property is required and to which they have not been adopted.

TABLE 1

| | |
|---|---|
| 1: | Steel No. |
| 2: | Type |
| 3: | Austenitic |
| 4: | Chemical Composition (wt %) |

TABLE 1-continued

| | |
|---|---|
| 5: | Remarks |
| 6: | Inventive Ex. |
| 7: | Comp. Ex. |

TABLE 2

| | |
|---|---|
| 8: | Steel No. |
| 9: | Type |
| 10: | Ferritic |
| 11: | Chemical Composition (wt %) |
| 12: | Remarks |
| 13: | Inventive Ex. |
| 14: | Comp. Ex. |

TABLE 3

| | |
|---|---|
| 15: | Steel No. |
| 16: | Type |
| 17: | Martensitic |
| 18: | Chemical Composition (wt %) |
| 19: | Remarks |
| 20: | Inventive Ex. |
| 21: | Comp. Ex. |

TABLE 4

| | | | |
|---|---|---|---|
| 22: | Steel No. | | |
| 23: | Type | | |
| 24: | Austenitic | | |
| 25: | (Silver particle + silver oxide + silver sulphide) | | |
| 26: | Area percentage | | |
| 27: | Mean grain diameter | | |
| 28: | Casting rate of continuous casting | | |
| 29: | Workability | | |
| 30: | Adhesion bending | Good (O) | Poor (X) |
| 31: | Corrosion resistance | | |
| 32: | Rusting area percentage | | |
| 33: | Antibacterial property | | |
| 34: | Prior to corrosion resistance test | | |
| 35: | After corrosion resistance test | | |
| 36: | Safety | | |
| 37: | Positive: + | Negative: − | |
| 38: | Remarks | | |
| 39: | Inventive Ex. | | |
| 40: | Comp. Ex. | | |

TABLE 5

| | |
|---|---|
| 41: | Ferritic |

TABLE 6

| | |
|---|---|
| 42: | Martensitic |

TABLE 1

| Steel | | Chemical Composition (wt %) | | | | | | | | | | | | | | | | | |
|---|---|---|---|---|---|---|---|---|---|---|---|---|---|---|---|---|---|---|---|
| No. | Type | C | Si | Mn | P | S | Cr | N | Al | Mo | Cu | Ni | Ti | Nb | Ag | Pt | Sn | Zn | Remarks |
| A 1 | | 0.05 | 0.30 | 1.02 | 0.03 | 0.006 | 18.2 | 0.04 | 0.002 | 0.03 | 0.30 | 8.30 | — | — | 0.010 | — | — | — | Inventive Ex. |
| A 2 | | 0.05 | 0.30 | 1.02 | 0.03 | 0.005 | 18.1 | 0.04 | 0.002 | 0.03 | 0.30 | 8.30 | — | — | 0.008 | 0.003 | — | — | Inventive Ex. |
| A 3 | | 0.05 | 0.30 | 1.02 | 0.03 | 0.005 | 18.2 | 0.04 | 0.001 | 0.03 | 0.30 | 8.30 | — | — | 0.008 | 0.003 | 0.002 | — | Inventive Ex. |
| A 4 | | 0.05 | 0.30 | 1.02 | 0.03 | 0.006 | 18.1 | 0.04 | 0.001 | 0.03 | 0.30 | 8.30 | — | — | 0.014 | — | 0.003 | 0.01 | Inventive Ex. |
| A 5 | | 0.05 | 0.30 | 1.02 | 0.03 | 0.006 | 18.2 | 0.04 | 0.002 | 0.03 | 0.30 | B.30 | — | — | 0.0005 | — | — | — | Inventive Ex. |
| A 6 | | 0.05 | 0.30 | 1.02 | 0.03 | 0.006 | 18.2 | 0.04 | 0.002 | 0.03 | 0.30 | 8.30 | — | — | 0.0005 | 0.002 | — | — | Inventive Ex. |
| A 7 | | 0.05 | 0.30 | 1.02 | 0.03 | 0.006 | 18.2 | 0.04 | 0.002 | 0.03 | 0.30 | 8.30 | — | — | 0.0004 | — | 0.002 | — | Inventive Ex. |
| A 8 | | 0.05 | 0.30 | 1.02 | 0.03 | 0.005 | 18.1 | 0.04 | 0.002 | 0.03 | 0.30 | 8.30 | — | — | 0.0004 | — | — | 0.002 | Inventive Ex. |
| A 9 | | 0.05 | 0.30 | 1.02 | 0.03 | 0.005 | 18.1 | 0.04 | 0.002 | 0.03 | 0.30 | 8.30 | — | — | 0.0004 | 0.005 | 0.005 | — | Inventive Ex. |
| A 10 | | 0.05 | 0.30 | 1.02 | 0.03 | 0.005 | 18.1 | 0.04 | 0.002 | 0.03 | 0.30 | 8.20 | — | — | 0.0005 | — | 0.010 | 0.005 | Inventive Ex. |
| A 11 | | 0.05 | 0.30 | 1.02 | 0.03 | 0.005 | 18.1 | 0.04 | 0.002 | 0.03 | 0.30 | 8.30 | — | — | 0.0006 | 0.007 | — | 0.005 | Inventive Ex. |
| A 12 | | 0.05 | 0.30 | 1.01 | 0.03 | 0.005 | 18.2 | 0.04 | 0.002 | 0.03 | 0.30 | 8.30 | — | — | 0.0005 | 0.010 | 0.005 | 0.010 | Inventive Ex. |
| A 13 | | 0.05 | 0.30 | 1.02 | 0.03 | 0.006 | 18.2 | 0.04 | 0.002 | 0.03 | 0.30 | 8.30 | — | — | — | — | — | — | Comp. Ex. |
| A 14 | | 0.05 | 0.30 | 1.02 | 0.03 | 0.006 | 18.2 | 0.04 | 0.002 | 0.03 | 0.30 | 8.30 | — | — | 2.1 | — | — | — | Comp. Ex. |

TABLE 2

| Steel | | Chemical Composition (wt %) | | | | | | | | | | | | | | | | | |
|---|---|---|---|---|---|---|---|---|---|---|---|---|---|---|---|---|---|---|---|
| No. | Type | C | Si | Mn | P | S | Cr | N | Al | Mo | Cu | Ni | Ti | Nb | Ag | Pt | Sn | Zn | Remarks |
| F 1 | | 0.01 | 0.30 | 0.40 | 0.03 | 0.005 | 17.7 | 0.01 | 0.002 | 0.002 | — | — | — | 0.42 | 0.025 | — | — | 0.0008 | Inventive Ex. |
| F 2 | | 0.01 | 0.25 | 0.40 | 0.03 | 0.006 | 17.6 | 0.01 | 0.001 | 0.002 | — | — | — | 0.48 | 0.010 | 0.004 | — | — | Inventive Ex. |
| F 3 | | 0.01 | 0.23 | 0.40 | 0.03 | 0.005 | 17.5 | 0.01 | 0.002 | 0.002 | — | — | — | 0.44 | 0.010 | 0.003 | 0.003 | — | Inventive Ex. |
| F 4 | | 0.01 | 0.24 | 0.40 | 0.03 | 0.005 | 17.4 | 0.01 | 0.001 | 0.002 | — | — | — | 0.45 | 0.022 | — | 0.005 | — | Inventive Ex. |
| F 5 | | 0.07 | 0.27 | 0.70 | 0.03 | 0.007 | 16.2 | 0.02 | 0.002 | 0.002 | — | 0.08 | — | — | 0.250 | — | — | — | Inventive Ex. |
| F 6 | | 0.07 | 0.26 | 0.60 | 0.03 | 0.007 | 16.2 | 0.02 | 0.002 | 0.002 | — | 0.08 | — | — | 0.290 | 0.009 | — | 0.004 | Inventive Ex. |
| F 7 | | 0.07 | 0.27 | 0.70 | 0.03 | 0.006 | 16.2 | 0.02 | 0.002 | 0.002 | — | 0.09 | — | — | 0.270 | 0.005 | 0.01 | — | Inventive Ex. |
| F 8 | | 0.07 | 0.26 | 0.70 | 0.03 | 0.006 | 16.2 | 0.02 | 0.002 | 0.002 | — | 0.09 | — | — | 0.280 | — | 0.008 | — | Inventive Ex. |
| F 9 | | 0.006 | 0.15 | 0.20 | 0.03 | 0.008 | 16.1 | 0.008 | 0.03 | — | — | 0.10 | 0.17 | — | 0.350 | — | — | — | Inventive Ex. |
| F 10 | | 0.006 | 0.15 | 0.20 | 0.03 | 0.008 | 16.1 | 0.008 | 0.03 | — | — | 0.10 | 0.17 | — | 0.420 | 0.005 | — | — | Inventive Ex. |
| F 11 | | 0.006 | 0.15 | 0.20 | 0.03 | 0.008 | 16.1 | 0.008 | 0.03 | — | — | 0.10 | 0.17 | — | 0.340 | 0.008 | 0.010 | 0.010 | Inventive Ex. |
| F 12 | | 0.006 | 0.15 | 0.20 | 0.03 | 0.008 | 16.1 | 0.008 | 0.03 | — | — | 0.10 | 0.17 | — | 0.320 | — | 0.015 | — | Inventive Ex. |
| F 13 | | 0.01 | 0.30 | 0.40 | 0.03 | 0.006 | 17.7 | 0.01 | 0.002 | 0.002 | — | — | — | 0.42 | — | — | — | — | Comp. Ex. |
| F 14 | | 0.01 | 0.30 | 0.40 | 0.03 | 0.006 | 17.6 | 0.01 | 0.002 | 0.002 | — | — | — | 0.45 | 0.0002 | — | — | 0.os | Inventive Ex. |
| F 15 | | 0.01 | 0.30 | 0.40 | 0.03 | 0.006 | 17.5 | 0.01 | 0.002 | 0.002 | — | — | — | 0.44 | 0.90 | 0.009 | 0.07 | 0.003 | Inventive Ex. |
| F 16 | | 0.07 | 0.27 | 0.70 | 0.03 | 0.007 | 16.2 | 0.02 | 0.002 | 0.002 | — | 0.08 | — | — | — | — | — | — | Comp. Ex. |
| F 17 | | 0.07 | 0.27 | 0.60 | 0.03 | 0.06 | 16.2 | 0.02 | 0.002 | 0.002 | — | 0.08 | — | — | 4.2 | 0.009 | 0.005 | — | Comp. Ex. |
| F 18 | | 0.006 | 0.15 | 0.20 | 0.03 | 0.008 | 16.1 | 0.008 | 0.03 | — | — | 0.10 | 0.17 | — | 0.020 | — | 0.003 | — | Inventive Ex. |
| F 19 | | 0.006 | 0.15 | 0.20 | 0.03 | 0.008 | 16.1 | 0.008 | 0.03 | — | — | 0.10 | 0.17 | — | 0.800 | — | 0.002 | — | Inventive Ex. |

TABLE 3

| Steel | | Chemical Composition (wt %) | | | | | | | | | | | | | | | | | |
|---|---|---|---|---|---|---|---|---|---|---|---|---|---|---|---|---|---|---|---|
| No. | Type | C | Si | Mn | P | S | Cr | N | Al | Mo | Cu | Ni | Ti | Nb | Ag | Pt | Sn | Zn | Remarks |
| M 1 | | 0.04 | 0.30 | 0.30 | 0.02 | 0.006 | 13.1 | 0.009 | 0.010 | — | — | — | — | — | 0.842 | — | — | — | Inventive Ex. |
| M 2 | | 0.04 | 0.30 | 0.30 | 0.02 | 0.006 | 13.1 | 0.009 | 0.010 | — | — | — | — | — | 0.850 | 0.007 | — | — | Inventive Ex. |
| M 3 | | 0.04 | 0.30 | 0.30 | 0.02 | 0.006 | 13.1 | 0.009 | 0.010 | — | — | — | — | — | 0.729 | — | 0.005 | — | Inventive Ex. |
| M 4 | | 0.04 | 0.30 | 0.30 | 0.02 | 0.006 | 13.0 | 0.009 | 0.010 | — | — | — | — | — | 0.900 | — | — | 0.004 | Inventive Ex. |
| M 5 | | 0.04 | 0.30 | 0.30 | 0.02 | 0.006 | 13.1 | 0.009 | 0.010 | — | — | — | — | — | 0.830 | 0.0005 | 0.0005 | — | Inventive Ex. |
| M 6 | | 0.04 | 0.30 | 0.30 | 0.02 | 0.005 | 13.1 | 0.009 | 0.010 | — | — | — | — | — | 0.785 | — | 0.003 | 0.001 | Inventive Ex. |
| M 7 | | 0.04 | 0.30 | 0.30 | 0.02 | 0.006 | 13.1 | 0.009 | 0.010 | — | — | — | — | — | 0.822 | 0.01 | — | 0.01 | Inventive Ex. |
| M 8 | | 0.04 | 0.30 | 0.30 | 0.02 | 0.005 | 13.0 | 0.009 | 0.010 | — | — | — | — | — | 0.843 | 0.001 | 0.005 | 0.005 | Inventive Ex. |
| M 9 | | 0.04 | 0.30 | 0.30 | 0.02 | 0.006 | 13.1 | 0.009 | 0.010 | — | — | — | — | — | — | — | — | — | Comp. Ex. |
| M 10 | | 0.04 | 0.30 | 0.30 | 0.02 | 0.006 | 13.1 | 0.009 | 0.010 | — | — | — | — | — | 4.8 | — | — | — | Comp. Ex. |
| M 11 | | 0.04 | 0.30 | 0.30 | 0.02 | 0.006 | 13.1 | 0.009 | 0.010 | — | — | — | — | — | 0.700 | — | — | — | Inventive Ex. |
| M 12 | | 0.04 | 0.30 | 0.30 | 0.02 | 0.006 | 13.1 | 0.009 | 0.010 | — | — | — | — | — | 0.800 | — | — | — | Inventive Ex. |

TABLE 4

| | | (Silver particle + Silver oxide + Silver sulphide) | | Casting rate of | Workability Adhension | Corrosion resistance | Antibacterial property | | | |
|---|---|---|---|---|---|---|---|---|---|---|
| Steel No. | Type | Area percentage (%) | Mean grain diameter (μm) | continuous casting (m/min) | bending Good (○) Poor (X) | Rusting area percentage (%) | Prior to corrosion resistance test (%) | After corrosion resistance test (%) | Safety Positive: + Negative: − | Remark |
| A 1 | | 0.02 | 0.03 | 0.9 | ○ | ○ | ○ | ○ | — | Inventive Ex. |
| | | 0.30 | 0.4 | 0.5 | ○ | Δ | ○ | Δ | — | Inventive Ex. |
| A 2 | | 0.02 | 0.02 | 1.5 | ○ | ○ | ◎ | ◎ | — | Inventive Ex. |
| | | 0.02 | 0.009 | 1.9 | ○ | ○ | Δ | Δ | — | Inventive Ex. |
| A 3 | | 0.01 | 0.08 | 0.8 | ○ | ○ | ◎ | ◎ | — | Inventive Ex. |
| A 4 | | 0.03 | 0.05 | 1.1 | ○ | ○ | ◎ | ◎ | — | Inventive Ex. |
| A 5 | | 0.001 | 0.002 | 1.0 | ○ | ○ | ○ | ○ | — | Inventive Ex. |
| A 6 | | 0.001 | 0.02 | 1.0 | ○ | ○ | ◎ | ○ | — | Inventive Ex. |
| A 7 | | 0.001 | 0.01 | 1.2 | ○ | ○ | ◎ | ○ | — | Inventive Ex. |
| A 8 | | 0.002 | 0.03 | 1.2 | ○ | ○ | ◎ | ○ | — | Inventive Ex. |
| A 9 | | 0.002 | 0.02 | 1.2 | ○ | ○ | ◎ | ○ | — | Inventive Ex. |
| A 10 | | 0.001 | 0.02 | 1.1 | ○ | ○ | ◎ | ◎ | — | Inventive Ex. |
| A 11 | | 0.002 | 0.02 | 1.1 | ○ | ○ | ◎ | ◎ | — | Inventive Ex. |
| A 12 | | 0.001 | 0.02 | 1.3 | ○ | ○ | ◎ | ◎ | — | Inventive Ex. |
| A 13 | | — | — | 0.9 | ○ | X | X | X | — | Comp. Ex. |
| A 14 | | 32 | 650 | 1.1 | ○ | X | ○ | X | — | Comp. Ex. |

TABLE 5

| | | (Silver particle + Silver oxide + Silver sulphide) | | Casting rate of | Workability Adhension | Corrosion resistance | Antibacterial property | | | |
|---|---|---|---|---|---|---|---|---|---|---|
| Steel No. | Type | Area percentage (%) | Mean grain diameter (μm) | continuous casting (m/min) | bending Good (○) Poor (X) | Rusting area percentage (%) | Prior to corrosion resistance test (%) | After corrosion resistance test (%) | Safety Positive: + Negative: − | Remarks |
| F 1 | | 0.08 | 5.2 | 1.3 | ○ | ○ | ◎ | ◎ | — | Inventive Ex. |
| F 2 | | 0.02 | 4.8 | 1.2 | ○ | ○ | ◎ | ◎ | — | Inventive Ex. |
| F 3 | | 0.05 | 3.2 | 1.0 | ○ | ○ | ◎ | ◎ | — | Inventive Ex. |
| F 4 | | 0.08 | 5.2 | 1.3 | ○ | ○ | ◎ | ◎ | — | Inventive Ex. |
| F 5 | | 0.90 | 9.1 | 1.2 | ○ | ○ | ◎ | ○ | — | Inventive Ex. |
| F 6 | | 0.95 | 7.5 | 1.1 | ○ | ○ | ◎ | ◎ | — | Inventive Ex. |
| F 7 | | 0.95 | 6.4 | 1.4 | ○ | ○ | ◎ | ◎ | — | Inventive Ex. |
| F 8 | | 0.94 | 8.2 | 1.3 | ○ | ○ | ◎ | ◎ | — | Inventive Ex. |
| F 9 | | 2.10 | 12 | 1.2 | ○ | ○ | ◎ | ◎ | — | Inventive Ex. |
| F 10 | | 4.10 | 20 | 1.0 | ○ | ○ | ◎ | ◎ | — | Inventive Ex. |
| F 11 | | 300 | 18 | 1.1 | ○ | ○ | ◎ | ◎ | — | Inventive Ex. |
| F 12 | | 2.70 | 10 | 1.4 | ○ | ○ | ◎ | ◎ | — | Inventive Ex. |
| F 13 | | — | — | 1.3 | ○ | ○ | X | X | — | Comp. Ex. |
| F 14 | | 0.005 | 0.002 | 0.9 | ○ | Δ | ○ | Δ | — | Inventive Ex. |

TABLE 5-continued

| Steel No. | Type | (Silver particle + Silver oxide + Silver sulphide) Area percentage (%) | Mean grain diameter (μm) | Casting rate of continouos casting (m/min) | Workability Adhension bending Good (○) Poor (X) | Corrosion resistance Rusting area percentage (%) | Antibacterial property Prior to corrosion resistance test (%) | After corrosion resistance test (%) | Safety Positive: + Negative: − | Remarks |
|---|---|---|---|---|---|---|---|---|---|---|
| F 15 | | 5.0 | 300 | 0.8 | ○ | Δ | ○ | Δ | — | Inventive Ex. |
| F 16 | | — | — | 1.2 | ○ | ○ | X | X | — | Comp. Ex. |
| F 17 | | 39.0 | 790 | 1.5 | X | x | ○ | X | — | Comp. Ex. |
| F 18 | | 0.12 | 8.1 | 1.1 | ○ | ○ | ⊙ | ⊙ | — | Inventive Ex. |
| F 19 | | 0.37 | 13 | 1.5 | ○ | ○ | ⊙ | ⊙ | — | Inventive Ex. |

15

TABLE 6

| Steel No. | Type | (Silver particle + Silver oxide + Silver sulphide) Area percentage (%) | Mean grain diameter (μm) | Casting rate of continuous casting (m/min) | Workability Adhension bending Good (○) Poor (X) | Corrosion resistance Rusting area percentage (%) | Antibacterial property Prior to corrosion resistance test (%) | After corrosion resistance test (%) | Safety Positive: + Negative: − | Remark |
|---|---|---|---|---|---|---|---|---|---|---|
| M 1 | | 4.0 | 0.4 | 1.3 | ○ | ○ | ⊙ | ○ | — | Inventive Ex. |
| M 2 | | 4.1 | 0.5 | 1.4 | ○ | ○ | ⊙ | ⊙ | — | Inventive Ex. |
| M 3 | | 3.6 | 0.05 | 1.4 | ○ | ○ | ⊙ | ⊙ | — | Inventive Ex. |
| M 4 | | 4.5 | 0.1 | 1.0 | ○ | ○ | ⊙ | ⊙ | — | Inventive Ex. |
| M 5 | | 4.0 | 0.1 | 1.0 | ○ | ○ | ⊙ | ⊙ | — | Inventive Ex. |
| M 6 | | 3.5 | 0.1 | 1.0 | ○ | ○ | ⊙ | ⊙ | — | Inventive Ex. |
| M 7 | | 4.1 | 0.1 | 1.0 | ○ | ○ | ⊙ | ⊙ | — | Inventive Ex. |
| M 8 | | 4.2 | 0.09 | 1.2 | ○ | ○ | ⊙ | ⊙ | — | Inventive Ex. |
| M 9 | | — | — | 1.0 | ○ | ○ | X | X | — | Comp. Ex. |
| M 10 | | 41.0 | 620 | 0.9 | X | X | ○ | X | — | Comp. Ex. |
| M 11 | | 3.5 | 0.1 | 2.1 | ○ | ○ | Δ | Δ | — | Inventive Ex. |
| M 12 | | 3.0 | 490 | 0.5 | ○ | Δ | Δ | Δ | — | Inventive Ex. |

What is claimed is:

1. A stainless steel having antibacterial property and containing about 10 wt % to 35 wt % Cr and 0.0001 to 1 wt % Ag, wherein said steel comprises a total of 0.001% or more in an area percentage of one or more members selected from the group consisting of silver particles dispersed in said stainless steel, a silver oxide and a silver sulphide.

2. The stainless steel having antibacterial property according to claim 1, wherein said stainless steel further comprises one or more members selected from the group consisting of Sn: 0.0002 to 0.02 wt %, Zn: 0.0002 to 0.02 wt % and Pt: 0.0002 to 0.01 wt %.

3. The stainless steel of claim 1, wherein said stainless steel is martensitic stainless steel.

4. The stainless steel of claim 1, wherein said stainless steel is ferritic stainless steel.

5. A stainless steel having antibacterial property and containing about 10 wt % to 35 wt % Cr and about 0.0001 to 1 wt % Ag, wherein said steel comprises a total of 0.001% or more in an area percentage of one or more members selected from the group consisting of silver particles, a silver oxide and a silver sulphide, wherein said silver particle, silver oxide and silver sulphide each have a mean grain diameter of 500 μm or less.

6. A stainless steel having antibacterial property and containing about 10 wt % to 35 wt % Cr and 0.0001 to 1 wt % Ag, wherein said steel comprises a total of 0.001% or more in an area percentage of one or more members selected from the group consisting of silver particles, a silver oxide and silver sulphide, wherein said one or more members are present in the steel independently or as a complex compound having two or three members.

7. The stainless steel according to claim 6, wherein said stainless steel further comprises one or more members selected from the group consisting of Sn: 0.0002 to 0.02 wt %, Zn: 0.0002 to 0.02 wt % and Pt: 0.0002 to 0.01 wt %.

8. The stainless steel of claim 6, wherein said stainless steel is martensitic stainless steel.

9. The stainless steel of claim 6, wherein said stainless steel is ferritic stainless steel.

10. The stainless steel of claim 6, wherein said silver particle, silver oxide and silver sulphide each have a mean grain diameter of 500 μm or less.

11. A method for producing a stainless steel material having antibacterial property, said method comprising continuously casting a molten stainless steel containing Cr: 10 wt % to 35 wt %, Ag: 0.0001 to 1 wt % to give a steel material, wherein the casting rate of said continuous casting ranges from 0.8 to 1.6 m/min.

12. The method of producing a stainless steel material having antibacterial property according to claim 11, wherein said molten stainless steel comprises one or more members selected from the group consisting of Sn: 0.0002 to 0.02 wt %, Zn: 0.0002 to 0.02 wt % and Pt: 0.0002 to 0.01 wt %.

13. A method of producing a cold-rolled stainless sheet steel, wherein the stainless steel obtained according to claim 11 or claim 12 is further subjected to hot-rolling, and/or cold-rolling.

14. The method of claim 11, further comprising subjecting the stainless steel to hot-rolling and the cold-rolling.

* * * * *

UNITED STATES PATENT AND TRADEMARK OFFICE

CERTIFICATE OF CORRECTION

PATENT NO. : 6,391,253 B1
DATED : May 21, 2002
INVENTOR(S) : Tochihara et al.

It is certified that error appears in the above-identified patent and that said Letters Patent is hereby corrected as shown below:

Column 10,
Table 1, No. A5, at the subheading "Ni", please change "B30" to -- 8.30 --;
Table 2, No. F3, at the subheading "Ag", please change "0.010" to -- 0.019 --;
No. "F14", at the subheading "Zn", please change "0.os" to -- 0.05 --; and
No. F17, at the subheading "Sn", please change "0.005" to -- 0.015 --.

Column 11,
Table 5, No. F7, at the subheading "Area percentage", please change "0.95" to -- 0.92 --; and
No. F11, please change "300" to -- 3.00 --.

Signed and Sealed this

Second Day of December, 2003

JAMES E. ROGAN
*Director of the United States Patent and Trademark Office*